US009809348B2

(12) United States Patent
Smalley

(10) Patent No.: US 9,809,348 B2
(45) Date of Patent: Nov. 7, 2017

(54) CARTON HAVING TEXTURE

(71) Applicant: Graphic Packaging International, Inc., Atlanta, GA (US)

(72) Inventor: Brian Smalley, Bristol (GB)

(73) Assignee: Graphic Packaging International, Inc., Atlanta, GA (US)

( * ) Notice: Subject to any disclaimer, the term of this patent is extended or adjusted under 35 U.S.C. 154(b) by 0 days.

(21) Appl. No.: 14/927,665

(22) Filed: Oct. 30, 2015

(65) Prior Publication Data

US 2016/0122072 A1 May 5, 2016

Related U.S. Application Data

(60) Provisional application No. 62/122,853, filed on Oct. 31, 2014.

(51) Int. Cl.

| | |
|---|---|
| ***B65D 5/42*** | (2006.01) |
| ***B65D 5/54*** | (2006.01) |
| ***B65D 5/02*** | (2006.01) |
| ***B65D 71/36*** | (2006.01) |

(52) U.S. Cl.

CPC ..... *B65D 5/425* (2013.01); *B65D 5/0227* (2013.01); *B65D 5/4266* (2013.01); *B65D 5/54* (2013.01); *B65D 71/36* (2013.01); *B65D 2571/0066* (2013.01); *B65D 2571/00141* (2013.01); *B65D 2571/00444* (2013.01); *B65D 2571/00728* (2013.01); *B65D 2571/00919* (2013.01)

(58) Field of Classification Search

CPC .... B65D 5/425; B65D 5/0227; B65D 5/4266; B65D 5/54; B65D 71/36; B65D 5/0236

USPC ..... 229/116.1, 102, 132, 136; 206/427, 434

See application file for complete search history.

(56) References Cited

U.S. PATENT DOCUMENTS

| | | | |
|---|---|---|---|
| 1,253,193 | A | 1/1918 | Hill |
| 2,383,183 | A | 8/1945 | Fischer |
| 2,594,376 | A | 4/1952 | Arneson |

(Continued)

FOREIGN PATENT DOCUMENTS

| | | |
|---|---|---|
| CA | 877792 | 8/1971 |
| CA | 2 160 145 | 9/1995 |

(Continued)

OTHER PUBLICATIONS

International Search Report and Written Opinion for PCT/US2015/058191 dated Jan. 27, 2016.

*Primary Examiner* — Christopher Demeree
(74) *Attorney, Agent, or Firm* — Womble Carlyle Sandridge & Rice, LLP

(57) ABSTRACT

A carton for holding a plurality of containers is disclosed. The carton includes a plurality of panels. The plurality of panels includes a top panel, a bottom panel, a first side panel, and a second side panel. The carton includes a plurality of end flaps. Each end flap of the plurality of end flaps is respectively foldably connected to a respective panel of the plurality of panels for at least partially closing an end of the carton. The carton further includes a plurality of lines of weakening positioned in at least one portion of the carton. The at least one portion of the carton being selected from the group consisting of at least one panel of the plurality of panels and at least one end flap of the plurality of end flaps. The plurality of lines of weakening forms at least one texture in the exterior of the carton.

39 Claims, 9 Drawing Sheets

(56) References Cited

U.S. PATENT DOCUMENTS 2,702,144 A 2/1955 Forrer
2,797,856 A 7/1957 Jaeschke
2,810,506 A 10/1957 Kessler
2,847,086 A 8/1958 Muller
2,868,433 A 1/1959 Anderson, Jr.
2,955,739 A 10/1960 Collura
3,076,591 A 2/1963 Nute et al.
3,112,856 A 12/1963 MacIntosh et al.
3,127,720 A 4/1964 Gentry et al.
3,180,486 A 4/1965 Kahler et al.
3,204,815 A 9/1965 Weiss
3,217,868 A 11/1965 Champlin et al.
3,309,005 A 3/1967 Pilger
3,334,767 A 8/1967 Cornelius et al.
3,355,012 A 11/1967 Weiss
3,381,881 A 5/1968 Granz et al.
3,828,926 A 8/1974 Rossi
3,886,901 A 6/1975 Zeitter
3,904,036 A 9/1975 Forrer
3,933,303 A 1/1976 Kirby, Jr.
3,994,432 A 11/1976 Kirby, Jr.
4,029,204 A 6/1977 Manizza
4,036,423 A 7/1977 Gordon
4,096,985 A 6/1978 Wood
4,111,306 A 9/1978 Roccaforte
4,216,861 A 8/1980 Oliff
4,318,474 A 3/1982 Hasegawa
4,329,923 A 5/1982 Iida
4,331,289 A 5/1982 Killy
4,364,509 A 12/1982 Holley, Jr. et al.
4,375,258 A 3/1983 Crayne et al.
4,378,905 A 4/1983 Roccaforte
4,382,505 A 5/1983 Sutherland et al.
4,424,901 A 1/1984 Lanier
4,440,340 A 4/1984 Bakx
4,478,334 A 10/1984 Graser
4,498,619 A 2/1985 Roccaforte
4,508,226 A 4/1985 Davis et al.
4,508,258 A 4/1985 Graser
4,538,759 A 9/1985 Dutcher
4,545,485 A 10/1985 Oliff
4,546,914 A 10/1985 Roccaforte
4,588,084 A 5/1986 Holley, Jr.
4,634,007 A 1/1987 Rusnock
4,653,686 A 3/1987 Wood et al.
4,706,876 A 11/1987 Wilson
4,746,061 A * 5/1988 Arvanigian ..... B65D 5/0236 206/807
4,747,487 A 5/1988 Wood
4,784,266 A 11/1988 Chaussadas
4,784,316 A 11/1988 Crouch
4,802,583 A 2/1989 Calvert et al.
4,830,267 A 5/1989 Wilson
4,875,586 A 10/1989 Chaussadas
4,928,877 A 5/1990 Lajovic
4,966,324 A 10/1990 Steel
4,989,778 A 2/1991 Saulas
5,020,337 A 6/1991 Krieg
5,060,792 A 10/1991 Oliff
5,094,359 A 3/1992 DeMars et al.
5,106,014 A 4/1992 Miller
5,119,985 A 6/1992 Dawson et al.
5,197,598 A 3/1993 Stout et al.
5,221,041 A 6/1993 Stout et al.
5,222,658 A 6/1993 DeMaio et al.
5,234,102 A 8/1993 Schuster et al.
5,246,112 A 9/1993 Stout et al.
5,249,681 A * 10/1993 Miller ..... B65D 71/36 206/427
5,263,612 A 11/1993 Nederveld
5,284,294 A 2/1994 Floyd
5,292,058 A 3/1994 Zoss et al.
5,297,725 A 3/1994 Sutherland
5,303,863 A 4/1994 Arasim
5,307,932 A 5/1994 Stout et al.
5,307,986 A 5/1994 Schuster
5,320,277 A 6/1994 Stout et al.
5,328,081 A 7/1994 Saulas
5,333,734 A 8/1994 Stout et al.
5,379,944 A 1/1995 Stout et al.
5,381,891 A 1/1995 Harris
5,385,234 A 1/1995 Stout et al.
5,395,044 A 3/1995 Stout
5,427,241 A 6/1995 Sutherland
5,458,234 A 10/1995 Harris
5,485,915 A 1/1996 Harris
5,495,727 A 3/1996 Strong et al.
5,503,324 A 4/1996 Bacchetti et al.
5,524,756 A 6/1996 Sutherland
5,551,556 A 9/1996 Sutherland
5,582,343 A 12/1996 Dalvey
5,582,344 A * 12/1996 Lawson ..... B65D 5/701 229/132
5,639,017 A 6/1997 Fogle
5,647,483 A 7/1997 Harris
5,669,500 A 9/1997 Sutherland
5,699,957 A 12/1997 Blin et al.
5,704,470 A 1/1998 Sutherland
5,738,273 A 4/1998 Auclair
5,794,778 A 8/1998 Harris
5,826,782 A 10/1998 Stout
5,857,615 A 1/1999 Rose
5,873,515 A 2/1999 Dunn et al.
5,878,946 A 3/1999 Frerot et al.
5,915,546 A 6/1999 Harrelson
5,992,733 A 11/1999 Gomes
5,996,883 A 12/1999 Bates
6,019,276 A 2/2000 Auclair
6,065,590 A 5/2000 Spivey
6,105,853 A 8/2000 Lamare
6,105,854 A 8/2000 Spivey et al.
6,131,803 A 10/2000 Oliff et al.
6,164,526 A 12/2000 Dalvey
6,170,741 B1 1/2001 Skolik et al.
6,227,367 B1 5/2001 Harrelson et al.
6,237,839 B1 5/2001 Brown
6,241,083 B1 6/2001 Harrelson
6,260,755 B1 7/2001 Bates et al.
6,302,320 B1 10/2001 Stout
6,425,520 B1 7/2002 Peterson
6,523,739 B2 2/2003 Heeley et al.
6,536,656 B2 3/2003 Auclair et al.
6,598,784 B2 7/2003 LaBras et al.
6,631,803 B2 10/2003 Rhodes et al.
6,758,337 B2 7/2004 Chargueraud et al.
6,848,573 B2 2/2005 Gould et al.
6,851,592 B1 2/2005 Owen et al.
6,905,066 B2 6/2005 Holley, Jr. et al.
6,926,193 B2 8/2005 Smalley
7,007,836 B2 3/2006 Smalley
7,427,010 B2 9/2008 Sutherland
7,472,791 B2 1/2009 Spivey, Sr.
7,743,968 B2 6/2010 Theelen
7,748,603 B2 7/2010 Fogle et al.
7,757,933 B2 7/2010 Dunn
7,806,314 B2 10/2010 Sutherland
8,439,253 B2 5/2013 Requena et al.
8,746,540 B2 * 6/2014 Hultberg ..... B65D 5/0227 206/807
8,808,062 B2 8/2014 Oh et al.
2001/0017314 A1 8/2001 Boukredine et al.
2003/0213263 A1 11/2003 Woog
2004/0074954 A1 4/2004 Fogle et al.
2005/0056658 A1 3/2005 Spivey
2005/0167478 A1 8/2005 Holley, Jr.
2006/0169755 A1 8/2006 Spivey
2006/0273143 A1 12/2006 Finch
2007/0039846 A1 2/2007 Spivey
2007/0051781 A1 3/2007 Holley
2007/0108261 A1 5/2007 Schuster
2007/0164091 A1 7/2007 Fogle et al.
2007/0205255 A1 9/2007 Dunn
2007/0295789 A1 12/2007 Ho Fung
2008/0067223 A1 3/2008 Jego

(56) References Cited

U.S. PATENT DOCUMENTS

| | | | |
|---|---|---|---|
| 2008/0145532 | A1 | 6/2008 | McDonald |
| 2009/0014508 | A1 | 1/2009 | Marie |
| 2009/0077927 | A1 | 3/2009 | Ross |
| 2009/0236408 | A1 | 9/2009 | Spivey, Sr. et al. |
| 2011/0000802 | A1 | 1/2011 | Weiss et al. |

FOREIGN PATENT DOCUMENTS

| | | |
|---|---|---|
| CH | 536 757 | 5/1973 |
| DE | 85 14 718 | 6/1985 |
| DE | 93 13 241 | 12/1993 |
| DE | 296 07 374 | 7/1996 |
| DE | 201 12 228 | 11/2002 |
| DE | 20 2004 018 649 | 5/2005 |
| EP | 0 331 972 | 10/1991 |
| EP | 0 473 266 | 3/1992 |
| EP | 0 500 258 | 8/1992 |
| EP | 1 381 545 | 1/2004 |
| EP | 1 612 157 | 1/2006 |
| FR | 2 481 231 | 10/1981 |
| FR | 2 662 141 | 11/1991 |
| GB | 2 206 565 | 1/1989 |
| JP | 2000-296569 | 10/2000 |
| JP | 2004-521032 | 7/2004 |
| KR | 10-0785977 | 12/2007 |
| OA | 00128 | 1/1966 |
| WO | WO 81 00090 | 1/1981 |
| WO | WO 95/11165 | 4/1995 |
| WO | WO 96/20874 | 7/1996 |
| WO | WO 96/21604 | 7/1996 |
| WO | WO 96/27538 | 9/1996 |
| WO | WO 99/28207 | 6/1999 |
| WO | WO 00/78618 | 12/2000 |
| WO | WO 01/66434 | 9/2001 |
| WO | WO 02/47990 | 6/2002 |
| WO | WO 02/085739 | 10/2002 |
| WO | WO 03/013839 | 2/2003 |
| WO | WO 03/037742 | 5/2003 |
| WO | WO 03/066452 | 8/2003 |
| WO | WO 2005/080218 | 9/2005 |
| WO | WO 2005/123532 | 12/2005 |
| WO | WO 2007/089282 | 8/2007 |

* cited by examiner

CARTON HAVING TEXTURE

CROSS-REFERENCE TO RELATED APPLICATION

This application claims the benefit of U.S. Provisional Patent Application No. 62/122,853, filed Oct. 31, 2014.

INCORPORATION BY REFERENCE

The disclosure of U.S. Provisional Patent Application No. 62/122,853, which was filed on Oct. 31, 2014, is hereby incorporated by reference for all purposes as if presented herein in its entirety.

BACKGROUND OF THE DISCLOSURE

The present disclosure generally relates to cartons for holding beverage containers or other types of articles. More specifically, the present disclosure relates to a carton with cuts or other weakening features forming a texture.

SUMMARY OF THE DISCLOSURE

In general, one aspect of the disclosure is generally directed to a carton for holding a plurality of containers. The carton includes a plurality of panels that extends at least partially around an interior of the carton. The plurality of panels includes a top panel, a bottom panel, a first side panel, and a second side panel. The carton includes a plurality of end flaps. Each end flap of the plurality of end flaps is respectively foldably connected to a respective panel of the plurality of panels for at least partially closing an end of the carton. The carton further includes a plurality of lines of weakening positioned in at least one portion of the carton. The at least one portion of the carton being selected from the group consisting of at least one panel of the plurality of panels and at least one end flap of the plurality of end flaps. The plurality of lines of weakening forms at least one texture in the exterior of the carton.

In another aspect, the disclosure is generally directed to a blank for forming a carton for hold a plurality of containers. The blank includes a plurality of panels comprising a top panel, a bottom panel, a first side panel, and a second side panel. The blank includes a plurality of end flaps. Each end flap of the plurality of end flaps is respectively foldably connected to a respective panel of the plurality of panels. The blank further includes a plurality of lines of weakening positioned in at least one portion of the blank. The at least one portion of the blank being selected from the group consisting of at least one panel of the plurality of panels and at least one end flap of the plurality of end flaps. The plurality of lines of weakening forms at least one texture in the exterior of the carton formed from the blank.

In another aspect, the disclosure is generally directed to a method of forming a carton. The method comprises obtaining a blank including a plurality of panels comprising a top panel, a bottom panel, a first side panel, and a second side panel. The blank includes a plurality of end flaps. Each end flap of the plurality of end flaps is respectively foldably connected to a respective panel of the plurality of panels. The blank comprises a plurality of lines of weakening positioned in at least one portion of the blank and the at least one portion of the blank being selected from the group consisting of at least one panel of the plurality of panels and at least one end flap of the plurality of end flap. The method comprises forming an interior of the carton at least partially defined by the plurality of panels, inserting a plurality of articles into the interior of the carton, and closing an end of the carton by at least partially overlapping the plurality of end flaps. The method further comprises forming at least one texture in the exterior of the carton from the plurality of lines of weakening.

Those skilled in the art will appreciate the above stated advantages and other advantages and benefits of various additional embodiments reading the following detailed description of the embodiments with reference to the below-listed drawing figures.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

The present invention generally relates to cartons that contain articles such as containers, bottles, cans, etc. The articles can be used for packaging food and beverage products, for example. The articles can be made from materials suitable in composition for packaging the particular food or beverage item, and the materials include, but are not limited to, glass; aluminum and/or other metals; plastics such as PET, LDPE, LLDPE, HDPE, PP, PS, PVC, EVOH, and Nylon; and the like, or any combination thereof.

Cartons according to the present invention can accommodate articles of any shape. For the purpose of illustration and not for the purpose of limiting the scope of the invention, the following detailed description describes beverage containers (e.g., aluminum beverage cans or glass bottles) as disposed within the carton embodiments. In this specification, the terms "lower," "bottom," "upper" and "top" indicate orientations determined in relation to fully erected and upright cartons.

Figure 1:
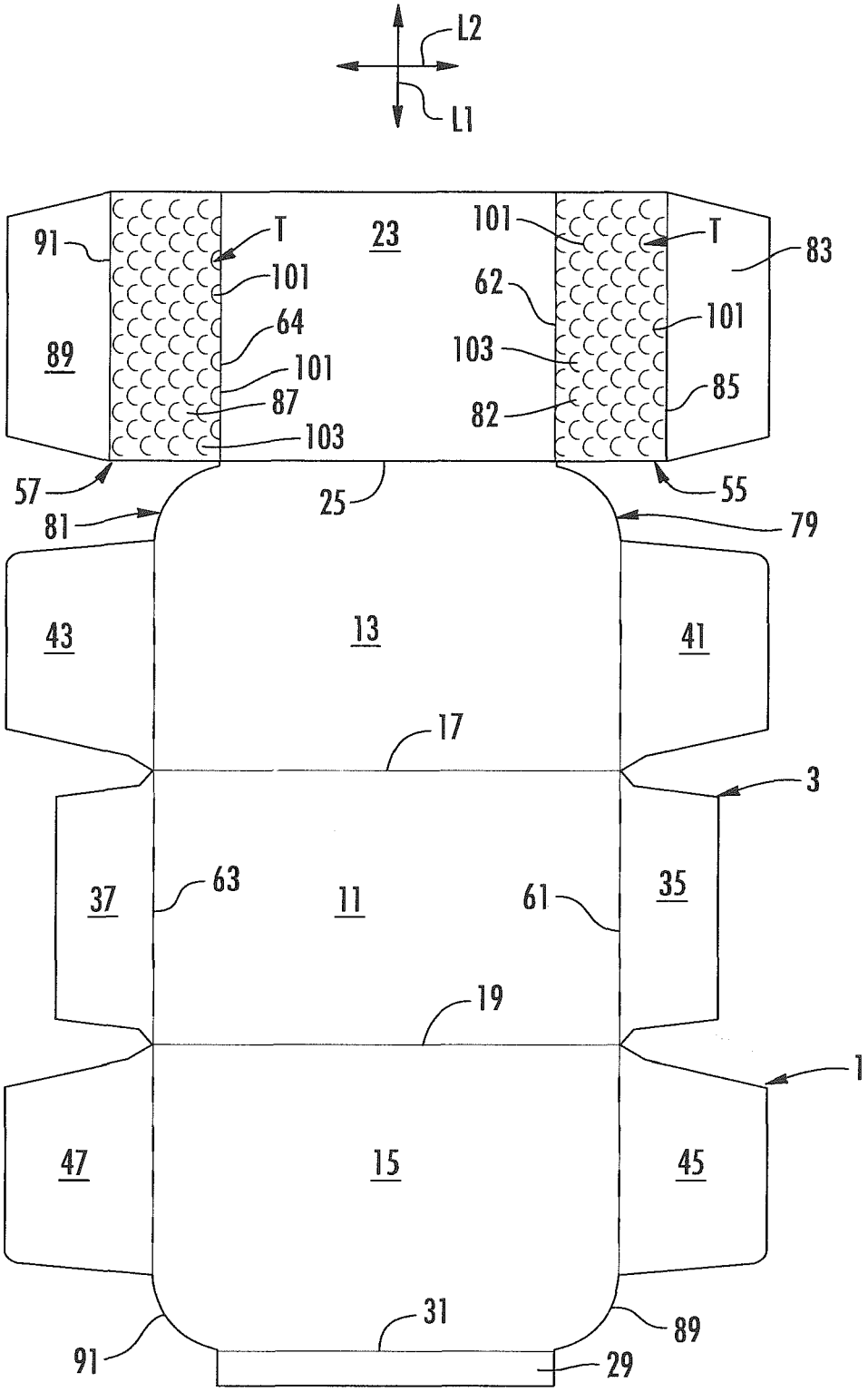
FIG. 1 is an exterior plan view of a blank used to form a carton in accordance with a first embodiment of the disclosure.
Figure 5:
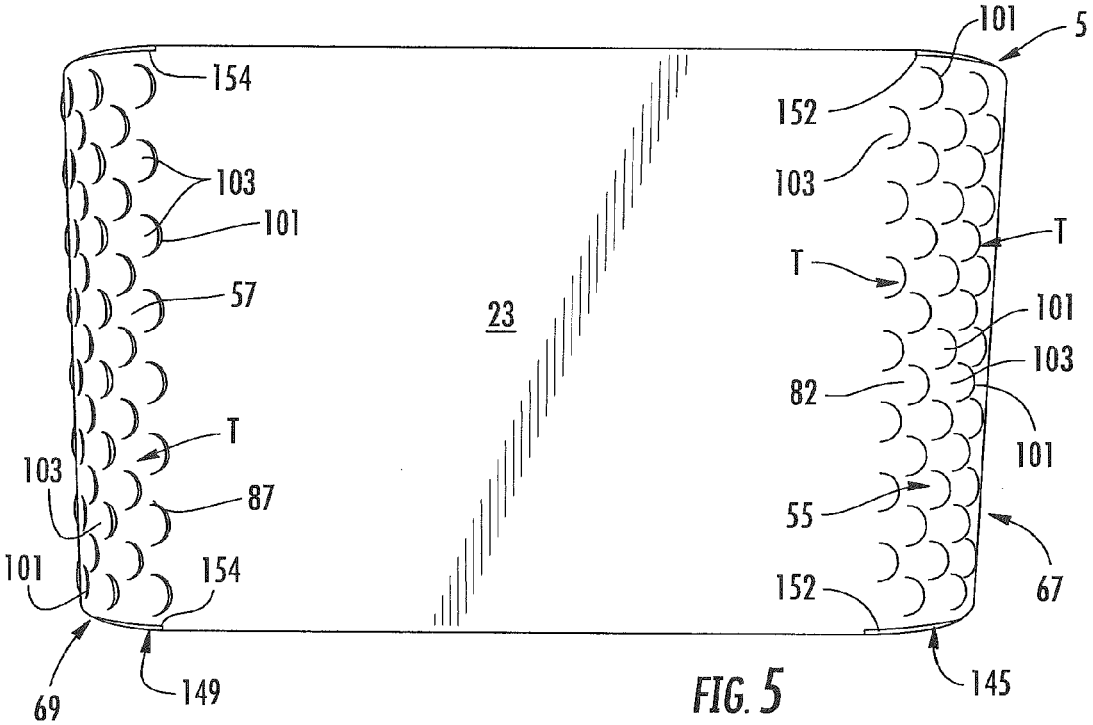
FIGS. 5-6 are various views of a carton formed from the blank of FIG. 1.

FIG. 1 is a plan view of the exterior side 1 of a blank, generally indicated at 3, used to form a carton 5 (FIG. 5) according to a first exemplary embodiment of the disclosure. The carton 5 can be used to house a plurality of articles such as containers C. In one illustrated embodiment, the carton 5 is sized to house twelve containers in one layer in a 3×4 arrangement, but it is understood that the carton may be sized and shaped to hold containers of a different or same quantity in a single layer, more than one layer, and/or in different row/column arrangements (e.g., 1×6, 4×6, 3×5×2, 2×6, 5×6, 2×6×2, 3×4×2, 2×9, etc.). In one embodiment, the containers C are cans, but other types of containers (e.g., glass or plastic bottles) can be used in the carton 5 without departing from the disclosure.

The blank 3 has a longitudinal axis L1 and a lateral axis L2. The blank 3 comprises a bottom panel 11 foldably connected to first and second side panels 13, 15 at respective lateral fold lines 17, 19, a top panel 23 foldably connected to the first side panel 13 at a lateral fold line 25, and an attachment flap 29 foldably connected to the second side panel 15 at a lateral fold line 31. The top panel 23 and attachment flap 29 will at least partially overlap in the erected carton 5. Any of the top and bottom panels 11, 23, the attachment flap 29, and the first and second side panels 13, 15 can be otherwise shaped, arranged, configured, or omitted, without departing from the disclosure. For example, the attachment flap 29 can be foldably connected to the top panel 23.

In the illustrated embodiment, the top panel 23 is foldably connected to a first top end flap 55 and a second top end flap 57. The bottom panel 11 is foldably connected to a first bottom end flap 35 and a second bottom end flap 37. The first side panel 13 is foldably connected to a first side end flap 41 and a second side end flap 43. The second side panel 15 is foldably connected to a first side end flap 45 and a second side end flap 47. The end flaps 35, 41, 45, 55 extend along a first marginal area of the blank 3, and in one embodiment the end flaps 35, 41, 45 are foldably connected to a respective panel 11, 13, 15 at a first longitudinal fold line 61. The end flaps 37, 43, 47, 57 extend along a second marginal area of the blank 3, and in one embodiment of the end flaps 37, 43, 47 are foldably connected to a respective panel 11, 13, 15 at a second longitudinal fold line 63. In one embodiment the top end flaps 55, 57 are foldably connected to the top panel 23 at respective longitudinal fold lines 62, 64. The longitudinal fold lines 61, 62, 63, 64 may be, for example, substantially straight, offset, or oblique at one or more locations to account for blank thickness or for other factors. When the carton 5 is erected, the end flaps 35, 41, 45, 55 at least partially close a first end 67 of the carton, and the end flaps 37, 43, 47, 57 close a second end 69 of the carton. In accordance with an alternative embodiment of the present invention, different flap arrangements can be used for closing the ends 67, 69 of the carton 5.

As illustrated in FIG. 1, the first side panel 13 has a first curved edge 79 extending between the longitudinal fold line 61 and the intersection of the lateral fold line 25 and the longitudinal fold line 62, and a second curved edge 81 extending between the longitudinal fold line 63 and the intersection of the lateral fold line 25 and the longitudinal fold line 64. In one embodiment, the second side panel 15 has a third curved edge 89 extending between the longitudinal fold line 61 and the lateral fold line 31, and a fourth curved edge 91 extending between the longitudinal fold line 63 and the lateral fold line 31. The curved edges 79, 89 are generally adjacent the first top end flap 55 and the curved edges 81, 91 are generally adjacent the second top end flap 57 when the blank is formed into a carton. The curved edges 79, 81, 89, 91 could be otherwise shaped, arranged, and/or configured without departing for the disclosure.

In one embodiment, the first top end flap 55 includes a first portion 82 foldably connected to the top panel 23 along fold line 62 and a second portion 83 foldably connected to the first portion 82 along longitudinal fold line 85. The second top end flap 57 includes a third portion 87 foldably connected to the top panel 23 along fold line 64 and a fourth portion 89 foldably connected to the first portion 87 along longitudinal fold line 91. The fold lines 62, 64, 85, 91 in the top panel 23 and top end flaps 55, 57 may be otherwise shaped, arranged, configured, and/or omitted without departing from the spirit of the disclosure. In one embodiment, the fold lines 62, 64, may serve as reference markers to indicate where the top end flaps 55, 57 begin to bend around the curved edges 79, 81, 89, 91 and fold lines 85, 91 may serve as reference markers to indicate where the bend in the top end flaps 55, 57 ends.

Figure 2:
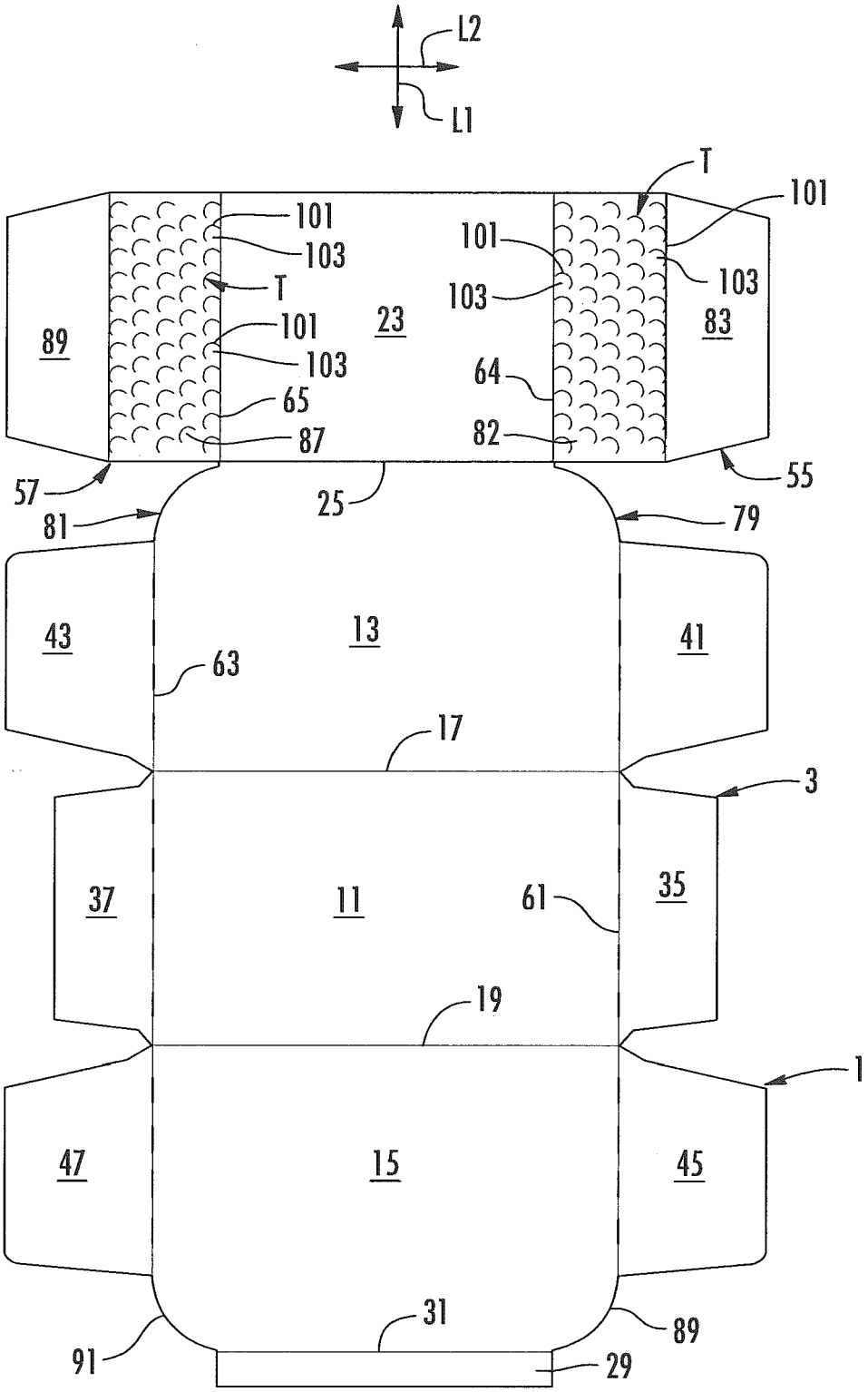
FIG. 2 is an exterior plan view of a blank used to form a carton in accordance with a second embodiment of the disclosure.
Figure 3:
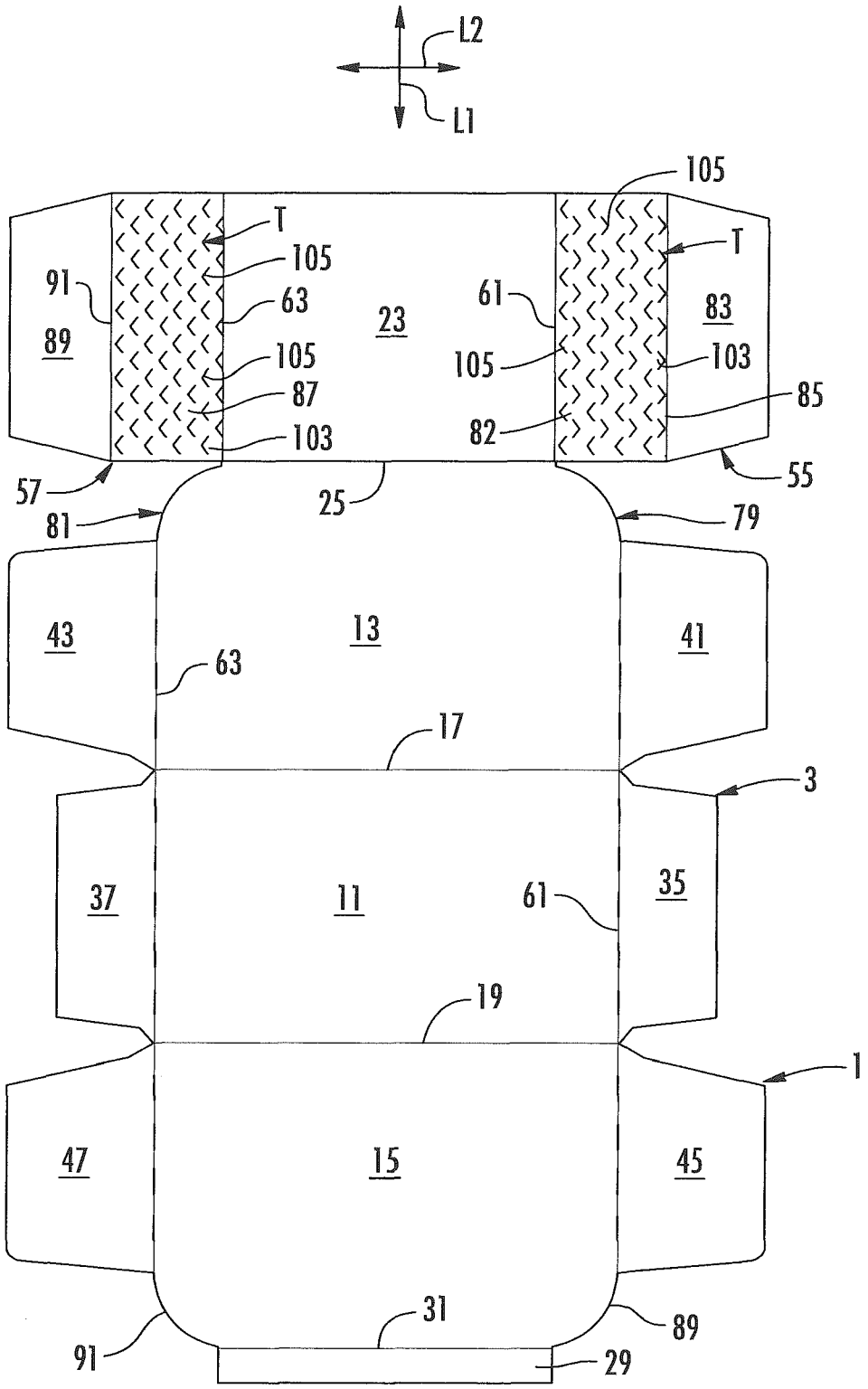
FIG. 3 is an exterior plan view of a blank used to form a carton in accordance with a third embodiment of the disclosure.
Figure 4:
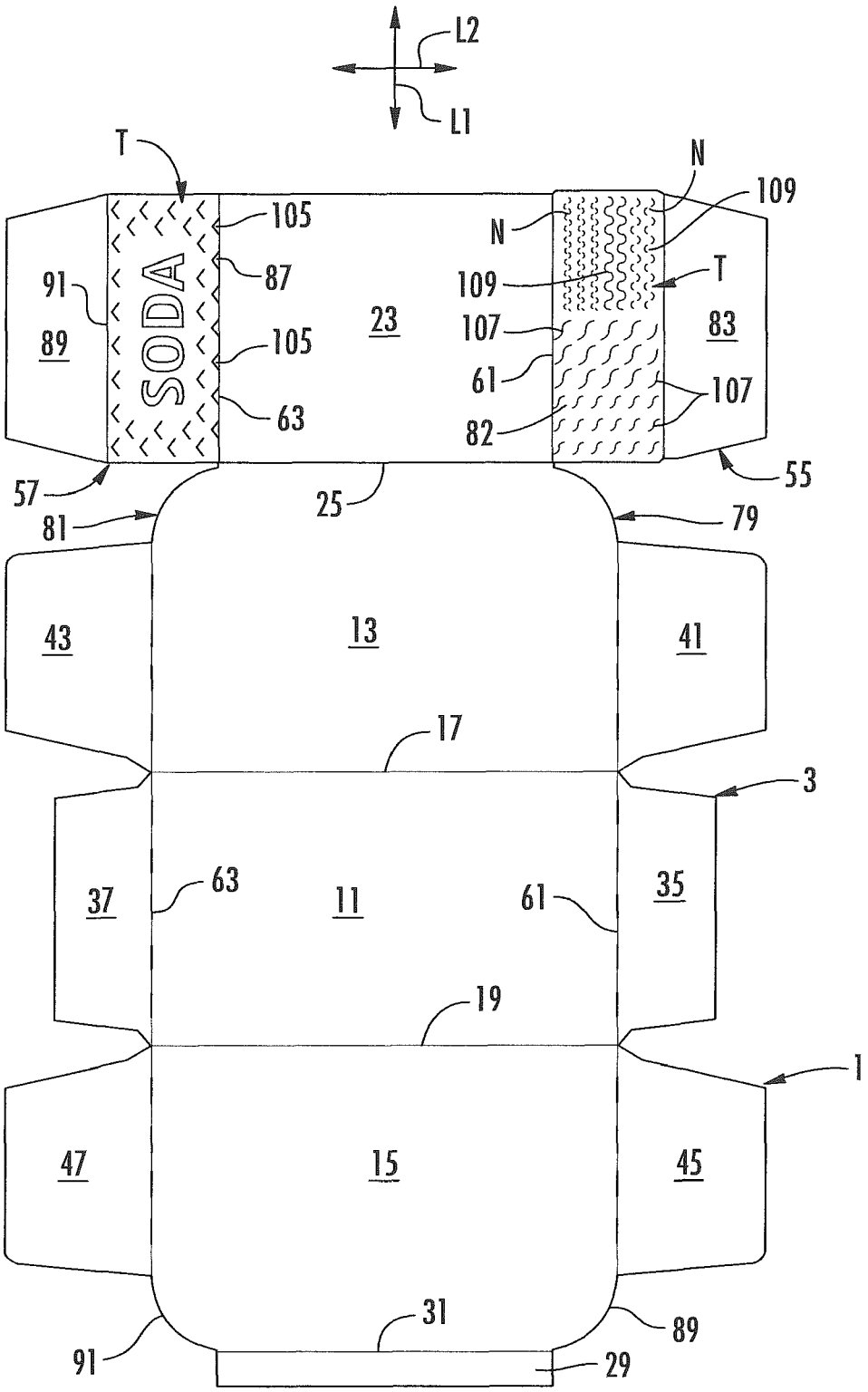
FIG. 4 is an exterior plan view of a blank used to form a carton in accordance with a fourth embodiment of the disclosure.

As illustrated in FIG. 1, the first portion 82 of top end flap 55 and third portion 87 of top end flap 57 may contain textures or patterns T formed by lines of weakening, for example, cuts and partial cuts 101 (e.g., 25%, 50%, 75% partial cuts) that form foldable flaps 103. The foldable flaps 103 of the textures T are positionable (e.g., foldable) relative to the remaining material of the portions 82, 87 to provide a unique touch and feel to the carton. The textures T may be applied to other areas such as handles, main display areas, and corners to distinguish the look and feel of these areas from the rest of the carton. The textures T can include various shapes, orientations, sizes, and arrangements. For example, the texture T can include arcuate or c-shaped cuts 101 (see FIGS. 1 and 2), v-shaped cuts 105 (see FIG. 3), s-shaped cuts 107 (see FIG. 4), z-shaped cuts, wave shaped cuts 109 with or without intermediate nicks N (see FIG. 4) or any other suitable shape. The textures T of the first portion 82 and second portion 87 may have similar orientations (see FIG. 1) wherein the cuts 101 of the textures T are in the same direction perpendicular to the lateral axis L2. Alternatively, as illustrated in FIG. 2, the first portion 82 and third portion 87 may include textures T with cuts 101 that are oriented to be generally oblique to the lateral axis L2 and the textures T of first portion 82 may be arranged in an opposite direction and/or a mirror image of the textures T of the third portion 87. Further, as illustrated in FIG. 3, the v-shaped cuts 105 of the textures T of each row in the first portion 82 may be arranged in alternating directions with respect the adjacent row.

As illustrated in FIGS. 1-4, the texture T may comprise 5-8 rows of cuts and flaps however; more or less rows may be used and each row may be aligned (see FIG. 4) or offset (see FIGS. 1-3) without departing from the spirit of the disclosure. In one embodiment, the top end panels 55, 57 may include textures T with cuts and flaps of various sizes (small, medium, and large) as illustrated in the first portion 81 of the blank 3 of FIG. 4. Each top end panel 55, 57 may include more than one texture, cut, panels, flaps, shape, orientation, size, and arrangement. Furthermore, the top end panels may comprise text forced by cut or other weakening features of the texture. The textures T could be otherwise shaped, arranged, and/or configured without departing from the disclosure.

An exemplary method of erecting the carton 5 from the blank 3 is discussed in detail below. At various stages of the erecting process, glue or other adhesive can be applied to various portions of the blank 3. In one embodiment, the blank 3 is folded about fold lines 17, 19, 25, 31 so that the top panel 23 overlaps the attachment flap 29 to form the generally open-ended sleeve. Adhesive or glue may be used to secure the top panel 23 to the attachment flap 29. Articles such as beverage containers C can be inserted into the open-ended sleeve prior to closing the ends 67, 69. Alternatively, one of the ends 67, 69 can be closed prior to inserting the beverage containers C into the carton 5.

In one embodiment, the first end 67 has a rounded top corner 145 and an orthogonal bottom corner 147. Similarly, the second end 69 has a rounded top corner 149 and an orthogonal bottom corner 151. The first end 67 can be closed by folding the first top end flap 55 to be in contact with, or closely adjacent to, the respective curved edges 79, 89 of the first and second side panels 13, 15 to form the rounded top corner 145. Further, the first end flap 55 can be in contact with a respective container C that is located at the rounded top corner 145 of the carton 5. Alternatively, the first end flap 55 can be closely adjacent to the container C at the corner 145.

Figure 6:
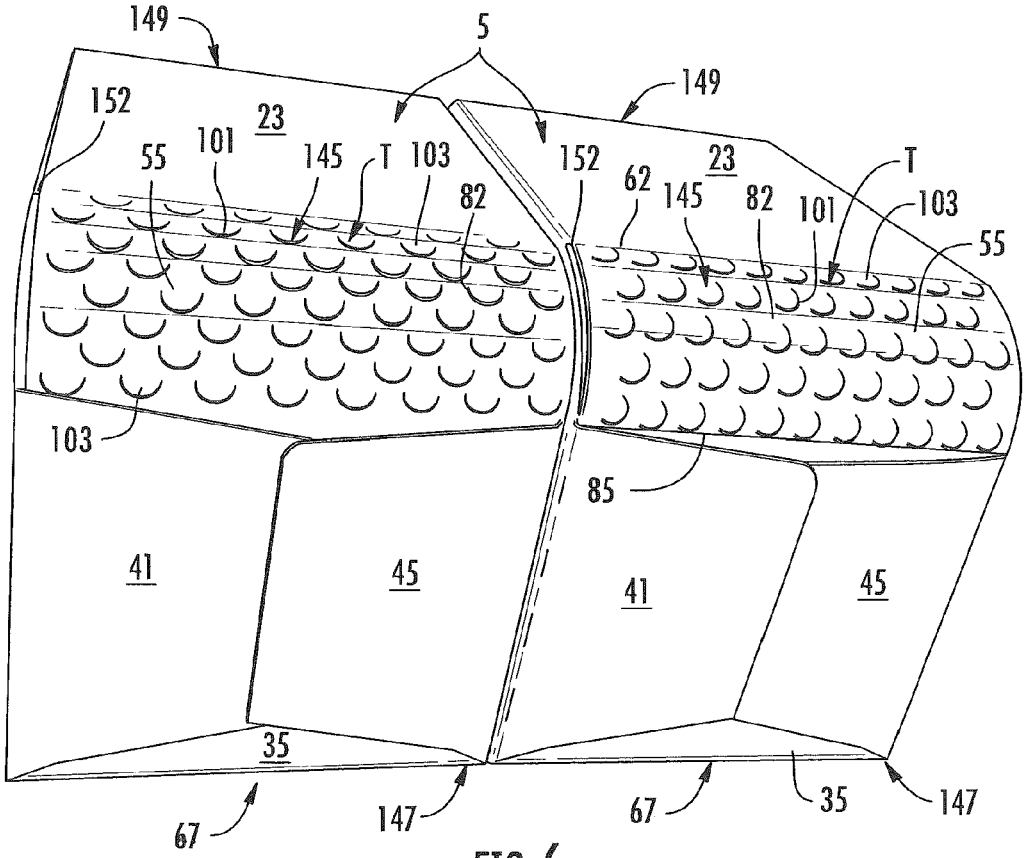

As shown in FIG. 6, openings 152 can be located at the rounded top corner 145 between the first top end flap 55 and the respective curved edges 79, 89. Similarly, openings 154 can be located at the rounded top corner 149 between the end top flap 57 and the respective curved edges 81, 91. The bottom end flap 35 is folded to partially form the orthogonal bottom corner. After folding the first top end flap 55 and the bottom end flap 35, the side end flaps 41, 45 are folded to overlap the overlapped first top end flaps and the bottom end flap forming the closed first end 67. The closed second end 69 is formed in a similar manner as described above for the first end 67, with the second end flap 57 cooperating with the curved edges 81, 91 of the side panels 13, 15 to form the rounded top corner 97, and the end flaps 37, 43, 47 cooperating to close the second end.

In one embodiment, the top end flaps 55, 57 are folded down to form textures T in the portions 82, 87 by activating or causing the flaps 103 to protrude adding a unique feel or touch to the textured area of the carton. The flaps 103 are folded outward from the end flaps 55, 57 to create edges at the cuts 101 that form the texture T. Alternatively, the first and second ends 67, 69 could be closed by other folding or positioning steps, or the ends could be otherwise shaped (e.g., having top and bottom rounded corners) without departing from the disclosure.

FIGS. 7-10 illustrate a plurality of different embodiments of cartons having cuts that form textures.

Figure 7:
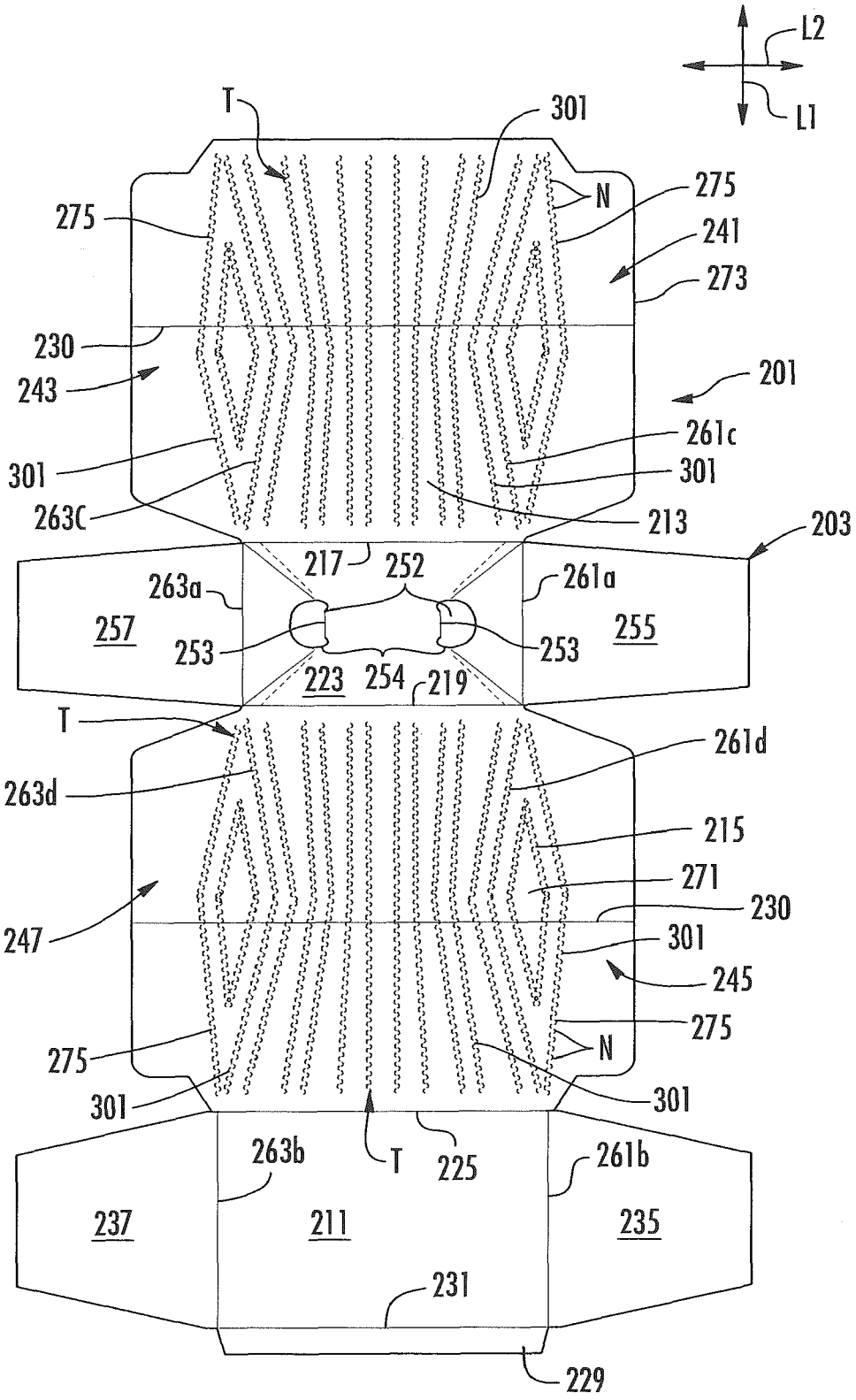
FIG. 7 is an exterior plan view of a blank used to form a carton in accordance with a fifth embodiment of the disclosure.
Figure 8:
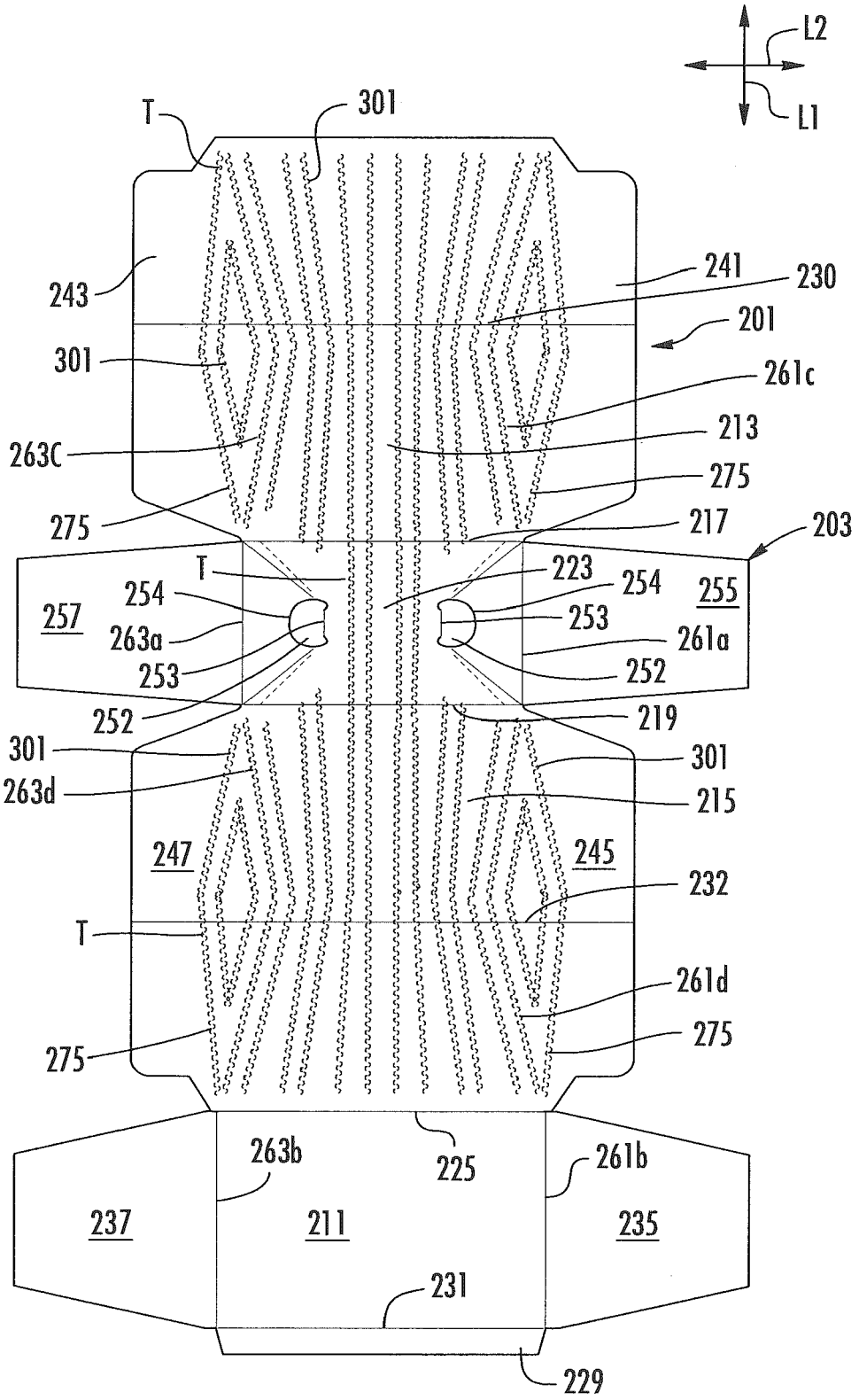
FIG. 8 is an exterior plan view of a blank used to form a carton in accordance with a sixth embodiment of the disclosure.
Figure 9:
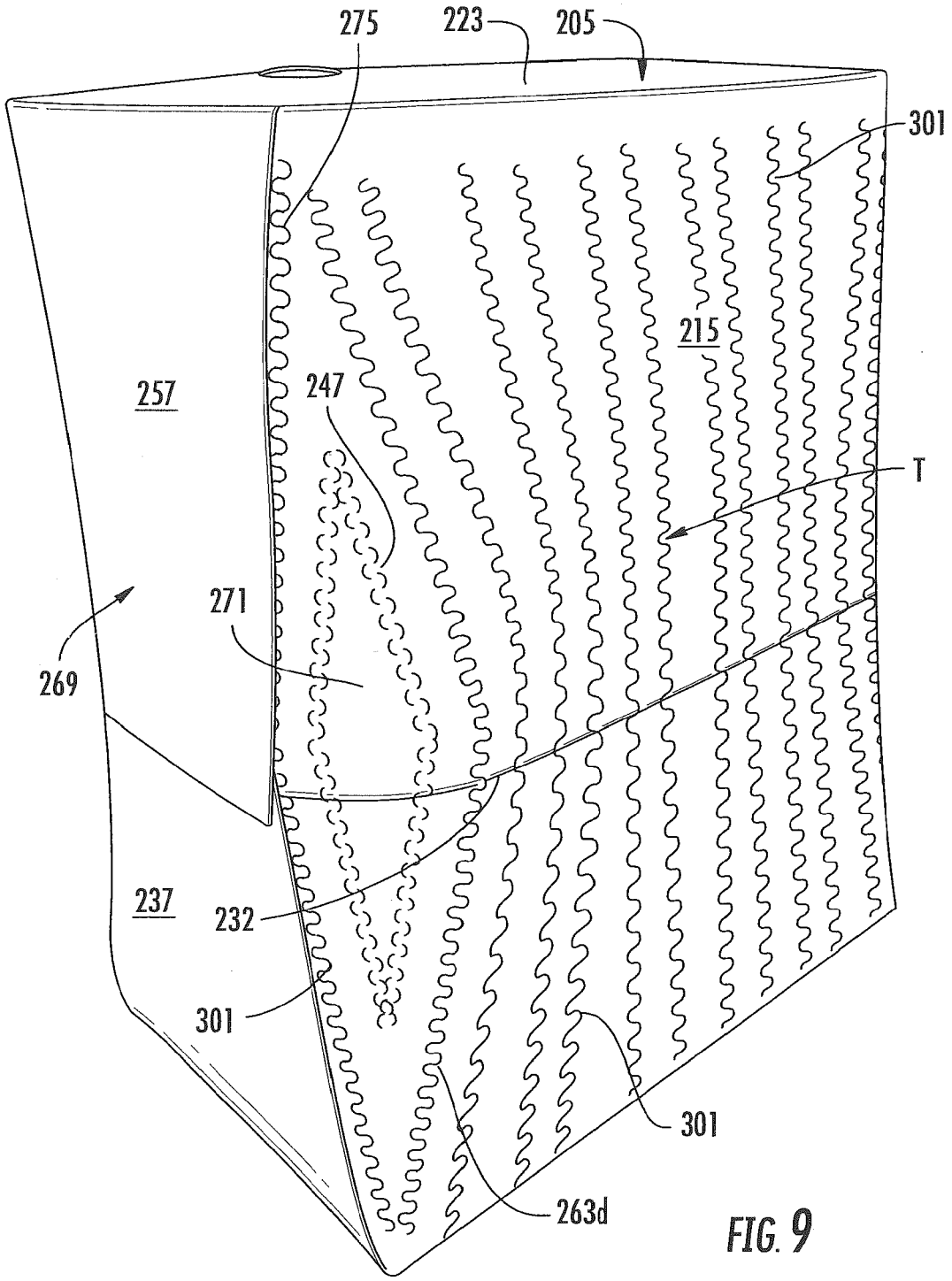
FIG. 9 is a perspective view of a carton formed from the blank of FIG. 7.
Figure 10:
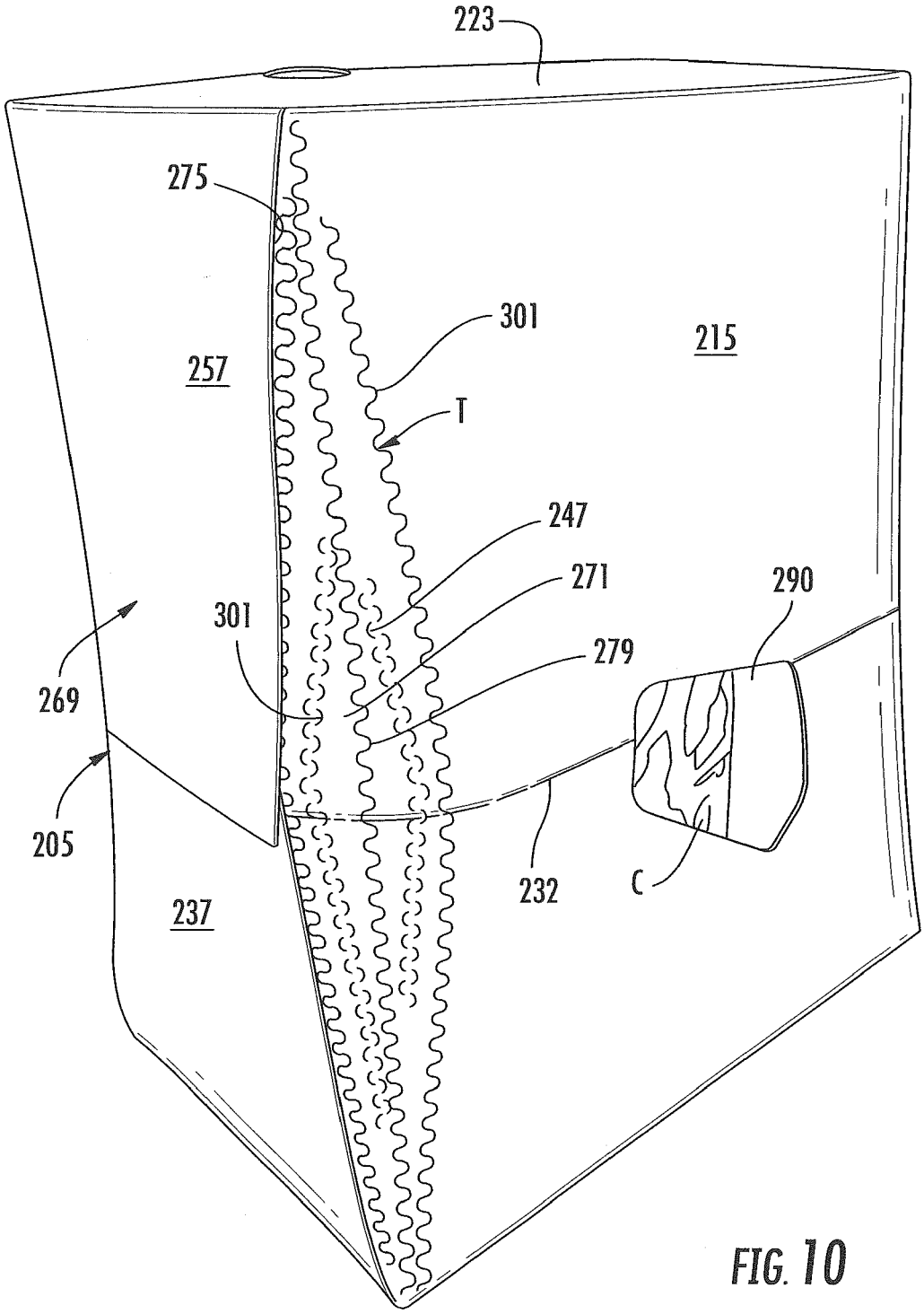
FIG. 10 is a perspective view of a carton in accordance with a seventh embodiment of the disclosure.

FIGS. 7-8 are plan views of the exterior side 201 of a blank, generally indicated at 203, used to form a carton 205 according to an alternative exemplary embodiment of the disclosure. The carton 205 can be used to house a plurality of articles such as containers C (FIG. 10). The blank 203 comprises a top panel 223 foldably connected to first and second side panels 213, 215 at respective lateral fold lines 217, 219, a bottom panel 211 foldably connected to the second side panel 215 at lateral fold line 225, and an attachment flap 229 foldably connected to the bottom panel 211 at a lateral fold line 231. The first side panel 213 and attachment flap 229 will at least partially overlap in the erected carton 5.

In the illustrated embodiment, the top panel 223 is foldably connected to a first top end flap 255 and a second top end flap 257 along respective lateral fold lines 261*a* and 263*a*. The bottom panel 211 is foldably connected to a first bottom end flap 235 and a second bottom end flap 237 along respective lateral fold lines 261*b* and 263*b*. The first side panel 213 is foldably connected to a first side end flap 241 and a second side end flap 243 along lines or areas of weakening 261*c* and 263*c*. The second side panel 215 is foldably connected to a first side end flap 245 and a second side end flap 247 along respective lines or areas of weakening 261*d*, 263*d*. When the carton 205 is erected, the end flaps 235, 255 at least partially close a first end 267 of the carton, and the end flaps 237, 257 close a second end 269 of the carton. In accordance with an alternative embodiment of the present invention, different flap arrangements can be used for closing the ends 267, 269 of the carton 205.

In one embodiment, the carton may comprise two finger tabs or handle portions 252 each defined by a cut 254 and foldably connected to the top panel 223 along fold line 253. The cuts 254 are generally arcuate however the cuts 254 and the finger tabs 252 may be otherwise shaped, arranged, configured, and/or omitted without departing from the disclosure.

As shown in FIG. 7, each of the side panels 213, 215 includes a respective lateral fold line 230, 232 extending across each respective side panel and across the respective end flaps 241, 243, 245, 247. The fold lines 230, 232 separate the carton into an upper portion and a lower portion. The upper portion is narrower than the lower portion thus conforming the carton to the shape of the containers such as glass bottles held therein. One or more of the fold lines 230, 232 could be omitted or could be otherwise shaped, arranged, configured, and/or positioned without departing from the disclosure.

In one embodiment the side panels 213, 215 may comprise an aperture or opening 290 (FIG. 10) for viewing and/or showing off the containers or products inside.

As illustrated in FIGS. 7-8, the first side panel 213 and second side panel 215 textures or patterns T formed by lines of weakening 301, for example, cuts and partial cuts. The textures T provide a unique touch and feel to the carton and may be applied to other areas such as handles (FIG. 8), main display areas, and corners. The textures T and lines of weakening 301 include various shapes, orientations, sizes, and arrangements. For example, the texture T may include cuts 301 that are generally a wave shape with or without intermediate nicks N or any other suitable shape. The textures T of first side panel 213 and second side panel 215 may have similar orientations (see FIG. 7).

As illustrated in FIGS. 7-8, the texture T may comprise lines of weakening in rows which are straight, generally v-shaped, bent, oblique, or have any other orientation. The texture T may comprise lines of weakening having shapes such as diamond, square, trapezoid, arcuate, and any other suitable shape. In one embodiment, the texture T may have lines of weakening of varying sizes (small, medium, and large). Each side end flaps 241, 243, 245, 247 and side panels 213, 215 may include more than one texture, shape, orientation, size, and arrangement. Furthermore, the textures T and lines of weakening could be otherwise shaped, arranged, and/or configured without departing from the disclosure.

An exemplary method of erecting the carton 205 from the blank 203 is discussed in detail below. At various stages of the erecting process, glue or other adhesive can be applied to various portions of the blank 203. In one embodiment, the blank 203 is folded about fold lines 217, 219, 225, 231 so that the side panel 213 overlaps the attachment flap 229 to form the generally open-ended sleeve. Adhesive or glue may be used to secure the side panel 213 to the attachment flap 229. Articles such as beverage containers C can be inserted into the open-ended sleeve prior to closing the ends 267,

269. Alternatively, one of the ends 267, 269 can be closed prior to inserting the beverage containers C into the carton 205.

In one embodiment, the first end 267 has diamond shaped corners 245. Similarly, the second end 269 has diamond shaped corners 249. The first end 267 can be closed by folding the side end flaps 241, 245 along lines of weakening 261*c*, 261*d* and 275 to at least partially form oblique corners 271. After folding the side end flaps 241, 245, the bottom end flap 235 is folded upward and the top end flap 255 is folded downward to overlap the side end flaps 241, 245 and the bottom end flap 235 forming the closed first end 267. The closed second end 269 is formed in a similar manner as described above for the first end 267, with the top end flap 257 cooperating and the end flaps 237, 243, 247 to close the second end. The first and second ends 267, 269 could be closed by other folding or positioning steps without departing from the disclosure.

The textures T formed by cuts 301 form portions of the carton that are raised or folded relative to other portions of the carton. In the embodiment of FIG. 8, one or more of the cuts 301 extend from the side panels 213, 215 and across the top panel 223. The textures T and cuts 101, 301 could be in any panel or flap without departing from the disclosure Any of the features of the various embodiments of the disclosure can be combined with, replaced by, or otherwise configured with other features of other embodiments of the disclosure without departing from the scope of this disclosure. Further, it is noted that the handle features and stress-relief areas of the various embodiments can be incorporated into a carton having any carton style or panel configuration. The carton styles and panel configurations described above are included by way of example.

The blanks according to the present invention can be, for example, formed from coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blanks. The blanks may also be coated with, for example, a moisture barrier layer, on either or both sides of the blanks.

In accordance with the exemplary embodiments, the blanks may be constructed of paperboard of a caliper such that it is heavier and more rigid than ordinary paper. The blanks can also be constructed of other materials, such as cardboard, hard paper, or any other material having properties suitable for enabling the carton package to function at least generally as described above. The blanks can also be laminated to or coated with one or more sheet-like materials at selected panels or panel sections.

The above embodiments may be described as having one or more panels adhered together by glue. The term "glue" is intended to encompass all manner of adhesives commonly used to secure carton panels or flaps in place.

In accordance with the above-described embodiments of the present disclosure, a fold line can be any substantially linear, although not necessarily straight, form of weakening that facilitates folding there along. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be a continuous slit penetrating a portion of the thickness of the material or penetrating the entire thickness of the material, or the like. For example, a cut line can be a continuous slit or could be wider than a slit without departing from the present disclosure.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton for holding a plurality of containers, the carton comprising:

a plurality of panels that extends at least partially around an interior of the carton, the plurality of panels comprises a top panel, a bottom panel, a first side panel comprising a first curved edge, and a second side panel comprising a second curved edge;

a plurality of end flaps comprising a first end flap foldably connected to the top panel and comprising a first portion foldably connected to the top panel and a second portion foldably connected to the first portion, each end flap of the plurality of end flaps is respectively foldably connected to a respective panel of the plurality of panels for at least partially closing an end of the carton, the first curved edge and the second curved edge of the respective first side panel and second side panel are generally adjacent the first end flap, and the first end flap is curved and cooperates with the first curved edge and the second curved edge to form a rounded corner of the carton; and a plurality of lines of weakening positioned in at least one portion of the carton, the plurality of lines of weakening are a plurality of cuts, the at least one portion of the carton being selected from the group consisting of at least one panel of the plurality of panels and at least one end flap of the plurality of end flaps, and the plurality of lines of weakening forms at least one texture in the exterior of the carton, the at least one texture comprises a plurality of foldable flaps formed by the plurality of lines of weakening, each foldable flap comprises at least one edge that is positioned relative to the at least one portion of the carton to form the at least one texture.

2. The carton of claim 1, wherein the plurality of cuts are in the first portion of the first end flap.

3. The carton of claim 1, wherein the plurality of lines of weakening comprises a plurality of cuts each having a shape selected from the group consisting of: C-shape, V-shape, S-shape, Z-shape, wave shape, and U-shape.

4. The carton of claim 3, further comprises a lateral axis and the plurality of cuts are oblique to the lateral axis.

5. The carton of claim 3, wherein the plurality of cuts is offset with respect to the adjacent row.

6. The carton of claim 1, wherein the plurality of lines of weakening comprises nicks between respective cuts of the plurality of cuts.

7. The carton of claim 1, wherein the plurality of end flaps comprises a second end flap foldably connected to the top panel, the second end flap comprises a third portion foldably connected to the top panel and a fourth portion foldably connected to the third portion.

8. The carton of claim 7, wherein the plurality of cuts are in the third portion of the second end flap, and the first side panel has a third curved edge and the second side panel has a fourth curved edge, the third curved edge and the fourth curved edge are generally adjacent the second end flap.

9. The carton of claim 1, wherein the plurality of cuts comprises a first row of cuts and a second row of cuts.

10. The carton of claim 9, wherein the cuts in the first row are in the same orientation as the cuts in the second row.

11. The carton of claim 9, wherein the cuts in the second row are in a different orientation as the cuts in the first row.

12. The carton of claim 1, wherein the at least one texture is disposed in at least a portion of each of the top panel, the first side panel, and the second side panel.

13. The carton of claim 1, wherein the carton comprises a rounded corner and the at least one texture is in the rounded corner.

14. The carton of claim 1, wherein the at least one texture is on the rounded corner.

15. The carton of claim 1, wherein the first portion is foldably connected to the top panel at a first fold line and the second portion is foldably connected to the first portion at a second fold line, and the first portion is curved to form the rounded corner extending between the first fold line and the second fold line.

16. The carton of claim 15, wherein the at least one texture is in the first portion.

17. A blank for forming a carton for holding a plurality of containers, the blank comprising:

a plurality of panels comprising a top panel, a bottom panel, a first side panel comprising a first curved edge, and a second side panel comprising a second curved edge;

a plurality of end flaps comprising a first end flap foldably connected to the top panel and comprising a first portion foldably connected to the top panel at a first fold line and a second portion foldably connected to the first portion at a second fold line, the first fold line extends from one of the first curved edge and the second curved edge, each end flap of the plurality of end flaps is respectively foldably connected to a respective panel of the plurality of panels, the first curved edge and the second curved edge of the respective first side panel and second side panel are generally adjacent the first end flap when the blank is formed into a carton; and a plurality of lines of weakening positioned in at least one portion of the blank, the plurality of lines of weakening are a plurality of cuts, the at least one portion of the blank being selected from the group consisting of at least one panel of the plurality of panels and at least one end flap of the plurality of end flaps, and the plurality of lines of weakening forms at least one texture in the exterior of the carton formed from the blank, the at least one texture comprises a plurality of foldable flaps formed by the plurality of lines of weakening, each foldable flap comprises at least one edge that is positioned relative to the at least one portion of the blank to form the at least one texture in the carton formed from the blank.

18. The blank of claim 17, wherein the plurality of cuts are in the first portion of the first end flap.

19. The blank of claim 17, wherein the plurality of lines of weakening comprises a plurality of cuts each having a shape selected from the group consisting of: C-shape, V-shape, S-shape, Z-shape, wave shape, and U-shape.

20. The blank of claim 19, further comprises a lateral axis and the plurality of cuts are oblique to the lateral axis.

21. The blank of claim 19, wherein the plurality of cuts is offset with respect to the adjacent row.

22. The blank of claim 17, wherein the plurality of lines of weakening comprises nicks between respective cuts of the plurality of cuts.

23. The blank of claim 17, wherein the plurality of end flaps comprises a second end flap foldably connected to the top panel, the second end flap comprises a third portion foldably connected to the top panel and a fourth portion foldably connected to the third portion.

24. The blank of claim 23, wherein the plurality of cuts are in the third portion of the second end flap, and the first side panel has a third curved edge and the second side panel has a fourth curved edge, the third curved edge and the fourth curved edge are generally adjacent the second end flap when the blank is formed into a carton.

25. The blank of claim 17, wherein the plurality of cuts comprises a first row of cuts and a second row of cuts.

26. The blank of claim 25, wherein the cuts in the first row are in the same orientation as the cuts in the second row.

27. The blank of claim 25, wherein the cuts in the second row are in a different orientation as the cuts in the first row.

28. The blank of claim 17, wherein the at least one texture is in the first portion.

29. A method for forming a carton, the method comprising:

obtaining a blank comprising a plurality of panels comprising a top panel, a bottom panel, a first side panel comprising a first curved edge, and a second side panel comprising a second curved edge, and a plurality of end flaps comprising a first end flap foldably connected to the top panel and comprising a first portion foldably connected to the top panel and a second portion foldably connected to the first portion, each end flap of the plurality of end flaps is respectively foldably connected to a respective panel of the plurality of panels, the first curved edge and the second curved edge are generally adjacent the first end flap, the blank comprises a plurality of lines of weakening positioned in at least one portion of the blank, the plurality of lines of weakening are a plurality of cuts, the at least one portion of the blank being selected from the group consisting of at least one panel of the plurality of panels and at least one end flap of the plurality of end flaps;

forming an interior of the carton at least partially defined by the plurality of panels;

inserting a plurality of articles into the interior of the carton;

closing an end of the carton by at least partially overlapping the plurality of end flaps such that the first end flap is curved and cooperates with the first curved edge and the second curved edge to form a rounded corner of the carton; and forming at least one texture in the exterior of the carton from the plurality of lines of weakening, the at least one texture comprises a plurality of foldable flaps forming by the plurality of lines of weakening, each foldable flap comprises at least one edge that is positioned relative to the at least one portion of the carton to form the at least one texture.

30. The method of claim 29, wherein the plurality of cuts are in the first portion of the first end flap.

31. The method of claim 29, wherein the plurality of lines of weakening comprises a plurality of cuts each having a shape selected from the group consisting of: C-shape, V-shape, S-shape, Z-shape, wave shape, and U-shape.

32. The method of claim 31, further comprises a lateral axis and the plurality of cuts are oblique to the lateral axis.

33. The method of claim 31, wherein the plurality of cuts is offset with respect to the adjacent row.

34. The method of claim 29, wherein the plurality of lines of weakening comprises nicks between respective cuts of the plurality of cuts.

35. The method of claim 29, wherein the plurality of end flaps comprises a second end flap foldably connected to the top panel, the second end flap comprises a third portion foldably connected to the top panel and a fourth portion foldably connected to the third portion.

36. The method of claim 35, wherein the plurality of cuts are in the third portion of the second end flap, and the first side panel has a third curved edge and the second side panel has a fourth curved edge, the third curved edge and the fourth curved edge are generally adjacent the second end flap.

37. The method of claim 29, wherein the plurality of cuts comprises a first row of cuts and a second row of cuts.

38. The method of claim 37, wherein the cuts in the first row are in the same orientation as the cuts in the second row.

39. The method of claim 37, wherein the cuts in the second row are in a different orientation as the cuts in the first row.

* * * * *